United States Patent [19]

Fuss

[11] Patent Number: 4,844,291

[45] Date of Patent: Jul. 4, 1989

[54] DISPENSING DEVICE

[75] Inventor: Gunter G. Fuss, San Carlos, Calif.

[73] Assignee: Free Flow Packaging Corporation, Redwood City, Calif.

[21] Appl. No.: 868,311

[22] Filed: May 28, 1986

[51] Int. Cl.[4] ..... B65D 47/08

[52] U.S. Cl. ..... 222/470; 222/506; 222/508

[58] Field of Search ..... 222/470, 469, 471, 472, 222/473, 502, 503, 506, 508, 560, 460, 505, 557, 460; 251/212; 141/108, 109; 294/55

[56] References Cited

U.S. PATENT DOCUMENTS

| | | | |
|---|---|---|---|
| 683,500 | 10/1901 | Sanger | 222/502 X |
| 909,188 | 1/1909 | James . | |
| 2,050,756 | 8/1936 | Kubo | 222/471 X |
| 2,056,102 | 9/1936 | Henderson | 222/502 |
| 2,246,354 | 6/1941 | Garlinghouse | 222/503 |
| 2,611,513 | 9/1952 | Kilpatrick | 222/181 |
| 2,668,427 | 2/1954 | Seeley | 222/460 X |
| 2,772,815 | 12/1956 | Bye | 222/471 X |
| 3,072,295 | 1/1963 | Lovette | 222/506 X |
| 3,074,543 | 1/1963 | Stanley | 206/46 |
| 3,116,854 | 1/1964 | Rabb et al. | 222/183 |
| 3,396,675 | 8/1968 | Stevens | 105/280 |
| 3,481,455 | 12/1969 | Graham et al. | 206/46 |
| 3,501,030 | 3/1970 | Flink | 214/17 |
| 3,735,915 | 5/1973 | Fuss | 229/17 B |
| 3,762,772 | 10/1973 | Fuss | 302/28 |
| 3,893,598 | 7/1975 | Fuss | 222/506 X |
| 3,901,419 | 8/1975 | Szendroi | 222/506 |
| 4,227,732 | 10/1980 | Kish | 222/506 X |

*Primary Examiner*—Joseph J. Rolla
*Assistant Examiner*—Stephen B. Parker
*Attorney, Agent, or Firm*—Flehr, Hohbach, Test, Albritton & Herbert

[57] ABSTRACT

A dispensing device for materials such as loose fill packaging material, is disclosed. The endwalls of the device housing are formed by corrugated sheets which are slit laterally from side to side and folded over into the inside of the housing to define hinged closure flaps. The housing sidewalls are attached to the endwalls by bolts or screws which extend through or are threaded into lateral flutes defined in the corrugated sheets. Also, cam follower rods are inserted into the flutes of the flaps. The flaps are biased together by a spring attached to the rods and are opened by a handle and attached cam plate.

13 Claims, 4 Drawing Sheets

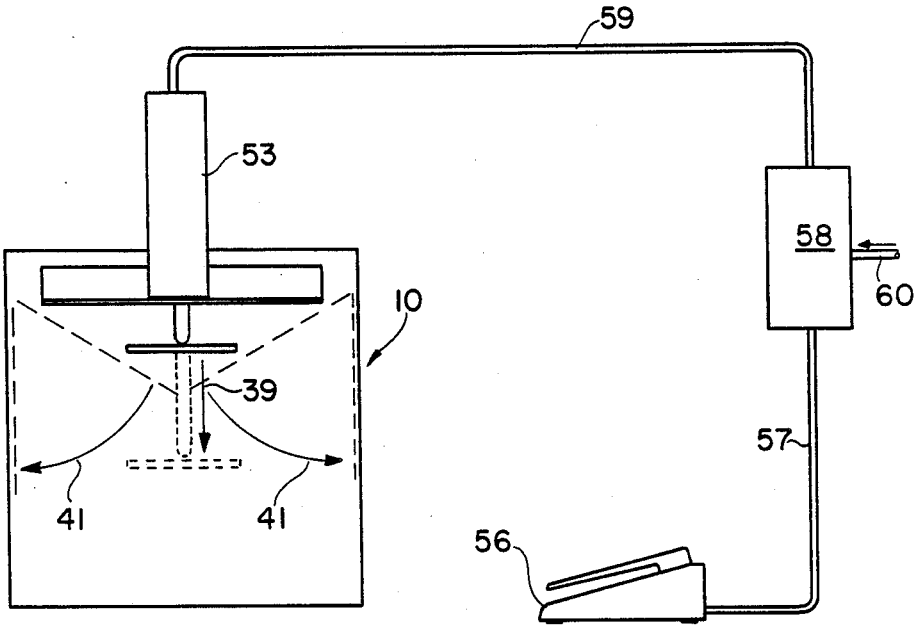
FIG. 9
FIG. 8
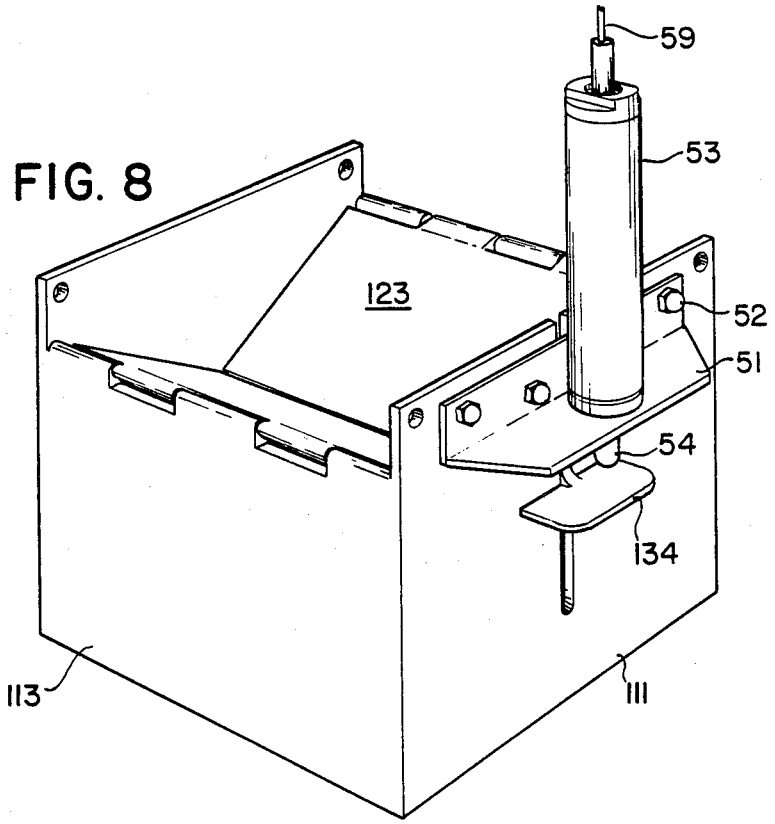

DISPENSING DEVICE

BACKGROUND OF THE INVENTION

The present invention relates to devices for dispensing flowable materials and in particular to a device suitable for dispensing lightweight subdivided materials such as loose fill packaging materials My dispensing device is used for selectively dispensing loose fill packaging materials of the type disclosed for example in commonly assigned Stanley U.S. Pat. No. 3,074,543 issued Jan 22, 1963, as well as commonly assigned Graham, et al U.S. Pat. No. 3,481,455 issued Dec. 2, 1969. To provide high throughput dispensing of such material, the dispensing device must be quickly and easily opened and closed to permit high rate dispensing by even an inexperienced operator. In addition, it is highly desirable that the device be of lightweight, durable construction, yet be easy to manufacture and repair.

Several relatively simple, easily operated devices are available for dispensing loose fill material. Commonly assigned Fuss U.S. Pat. No. 3,735,915 issued May 29, 1973 discloses a dispensing hopper which is formed from a blank of corrugated cardboard or similar material and has a dispensing flap which is an integral part of the hopper. For dispensing, the flap is manually pivoted open along a fold line using an integral pull tab. Also, commonly assigned Fuss U.S. Pat. No. 3,893,598 issued July 8, 1975 discloses a dispensing devices which includes a pair of closure flaps that are cammed open by a squeeze handle. However, in the main, the available dispensing devices were developed for nonanalogous technologies and involve relatively complex construction and/or operation which are inapplicable to the dispensing of loose fill packaging material.

SUMMARY OF THE INVENTION

In view of the above discussion it is a principal object of the present invention to provide an easily operated, fast acting dispensing device which is suitable for dispensing free flowing subdivided loose fill packaging material.

It is a related object to provide such a device which is relatively simple in construction, easy to manufacture and repair, easy to operate, fast acting and durable.

In one aspect, a dispensing device which incorporates my present invention includes a pair of sidewalls which mount hinged, corrugated plastic endwalls therebetween. Each plastic endwall is slit at the top and folded over so that it forms a hinged closure flap. The two hinged flaps are interconnected and biased shut by a tension spring and are opened by a cam plate acting on two cam followers which are attached to the flaps. The cam in turn is supported and moved by a handle which extends through a slot in one of the sidewalls. In a preferred simple construction which takes advantage of the structure of the corrugated plastic, the corrugated plastic endwalls are mounted to the sidewalls by rods which are pressed into or through the flutes of the corrugated plastic, and the cam followers are pins which are pressed into the flutes.

BRIEF DESCRIPTION OF THE DRAWING

FIG. 8 depicts another alternative embodiment of my invention in the form of a fluidic cylinder-operated dispensing device; and FIG. 9 is a schematic of a fluidic control circuit for the device of FIG. 8.

DETAILED DESCRIPTION OF THE PREFERRED EMBODIMENT

Figure 1:
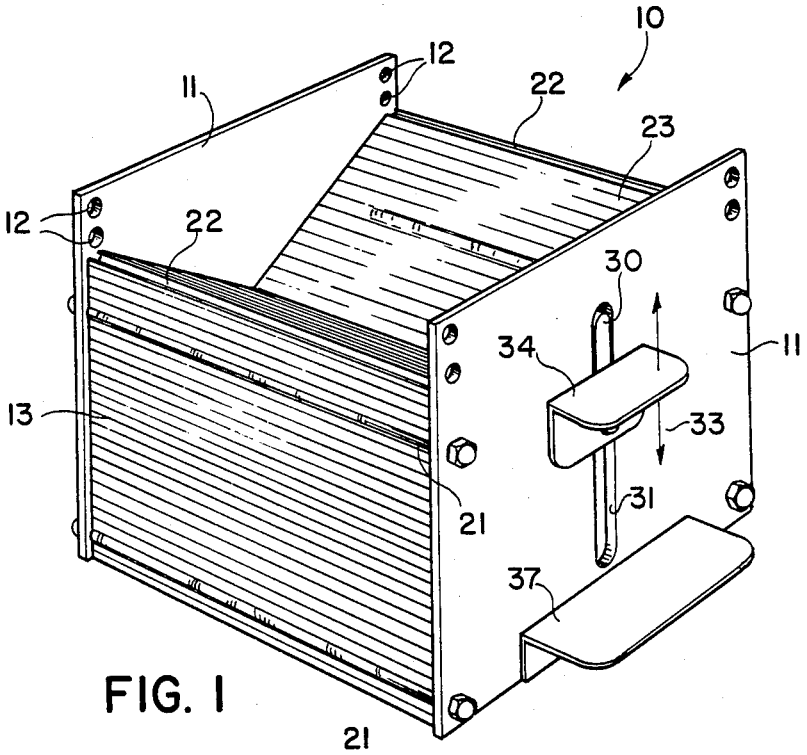
FIG. 1 is a perspective view of one embodiment of my dispensing device.

Referring to FIG. 1, there is shown a presently preferred embodiment 10 of my dispensing device. The dispensing device 10 comprises four walls or panels, specifically, two opposite side panels 11 and two opposite end panels 13. Holes 12 are formed at the opposite upper ends of the side panels 11—11 for mounting the dispensing device to a dispensing spout or other discharge member of a conveyor system, container, etc.

Figure 2:
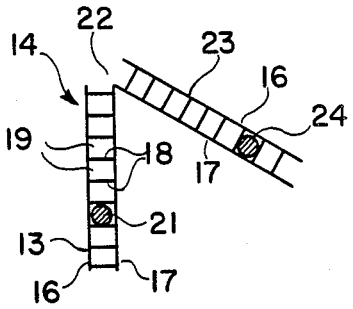
FIG. 2 is a longitudinal sectional view of a closure flap - forming corrugated end panel of the device of FIG. 1.

Referring to the cross-section view of the end panel shown in FIG. 2, preferably the end panels 13 have a corrugated construction. Preferably, these panels are formed of material such as polypropylene. Examples of suitable panels include the COR-X TM polypropylene corrugated panels available from Primex Plastics Corporation, Garfield, N.J. The thin corrugated panels 14 comprise outer and inner surfaces or sheets 16 and 17 which are spaced apart and supported by spaced ribs 18 which define lateral flutes or openings 19 therebetween. The side panels 13 are mounted to the plastic end panels 11 by rods 21 which are pressed into or through (or screwed into or through) the lateral flutes 19 in the corrugated end material. The corrugated material is available in sheets of various gauges having flutes 19—19 which provide a snug friction fit for various sized rods 21 so that the ends panels are securely positioned without play on the bolts.

Referring further to FIGS. 1 and 2, the outer sheet 16 of each corrugated panel 14 has a slit 22 formed intermediate its length at the upper end of the end panel 13, and is folded over at the slit, so that the corrugated panel 14 defines an end panel 13 and a joined, hinged closure flap 23. As shown most clearly in FIG. 3, a pin or rod 24 is inserted or screwed into one of the flutes of each flap 23. Typically, the pin 24 is pressed into the mating flute and is retained by friction. Also, a tension spring 26 is mounted to the protruding ends of the pins 24 to resiliently bias the flaps into the normally closed position which is depicted in FIG. 5.

Figure 4:
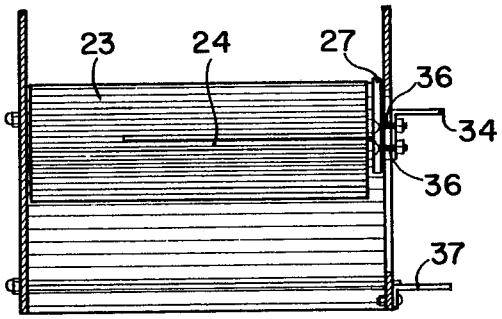
FIG. 4 is a sectional view taken along the lines 4—4 in FIG. 3.
Figure 6:
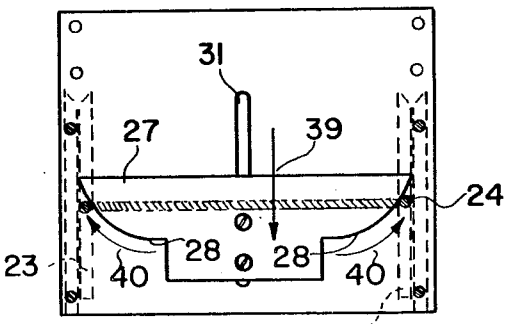
FIG. 6 is a sectional view, similar to that of FIG. 5, but showing the cam in the downward, flap opening position.
Figure 5:
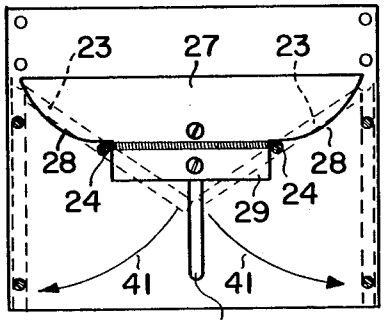
FIG. 5 is a sectional view taken along the lines 5—5 in FIG. 3, illustrating the flaps and end panels in phantom.

Referring to FIGS. 4–6, a cam member or plate 27 having curved bottom camming surfaces 28 rests on the cam follower pins 24 adjacent one of the side panels 11. Preferably, the cam is formed of durable material such as high density polyethylene. As shown in FIG. 5, bottom tab 29 of the cam 27 maintains a predetermined minimum spacing between the rods 24 corresponding to the desired closed position of the flaps. A slot 31 is formed in the adjacent side panel, aligned with the vertical path of the cam member (see arrow 33, FIG. 1). As is perhaps best shown in FIGS. 1 and 4, an external handle 34 is mounted via spacer 30 to the cam member 27 by screws 36. The spacer 30 rides within slot 31 and is slightly thicker than the material of panel 11 to prevent a clamp fit among the handle 34, panel 11 and flaps 23. A cooperating second fixed handle 37 is mounted to the bottom of the side panel.

As a consequence of the above construction, the flaps 23 are easily pivoted open by gripping the handles 34 and 37 and squeezing the handles together so that the movable handle 34 and the cam 27 are moved downwardly. See arrow 39, FIG. 6. Downward movement of the cam surfaces 28 forces the cam follower rods 24 to move in a generally outward direction along path 40, thereby pivoting attached flaps 23 along path 41, FIG. 5, to the open position shown in phantom in FIG. 6.

Figure 3:
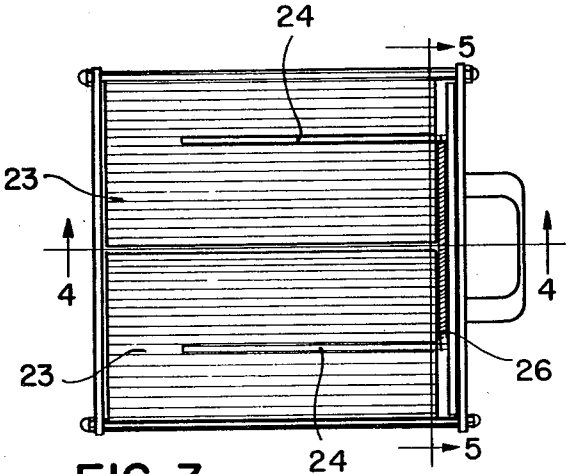
FIG. 3 is a top plan view of the dispensing device of FIG. 1.

Conversely, when the handle 34 is released, biasing spring 26 returns flaps 23 to the normally closed position shown in FIGS. 1, 3 and 5, thereby returning cam 27 and handle 34 to the associated, upper position.

The above described dispensing device 10 achieves the above identified objects of durability, ease of manufacture and repair, and easy, fast dispensing operation. In particular, the corrugated panel construction provides easily-operated yet durable flaps. In addition, the unitary end member and flap construction provided by the corrugated panels contributes to the overall simplicity of construction and assembly, as does the use of the flutes to mount the assembly rods 21 and the cam follower pins 24.

Figure 7:
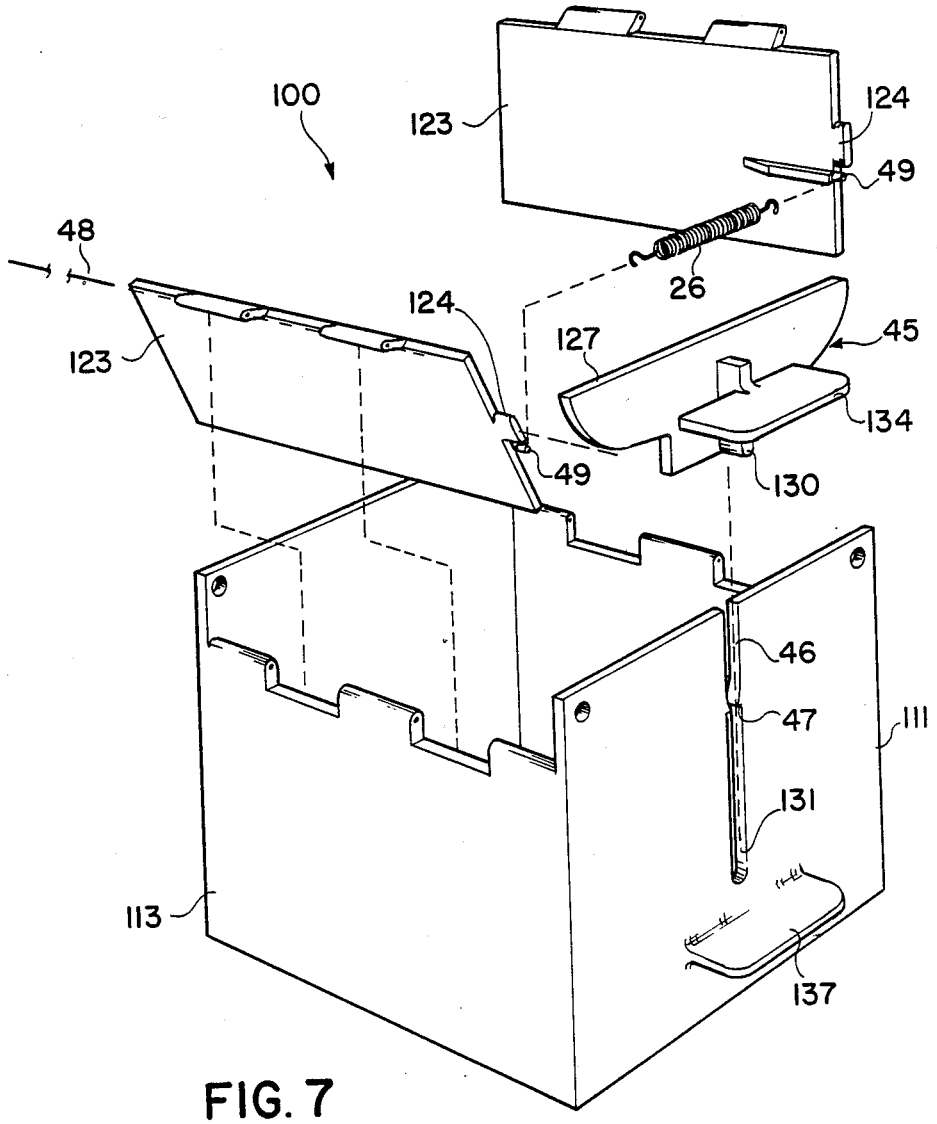
FIG. 7 depicts an exploded perspective view of an alternative embodiment of my dispensing device.

In referring to the various alternative aspects of my invention shown in FIGS. 7–9, newly introduced components are identified by new reference numerals, whereas components which are modified versions of the components numbered xx in FIGS. 1–6 are identified by the prefix 1xx. Thus, the modified embodiment of handle 34 is identified as 134 in FIG. 7.

Referring now specifically to FIG. 7, in one alternative embodiment, handle 134, spacer 130 and cam 127 can be molded as a single unitary part or assembly 45. To accommodate this molded cam assembly 45, the adjacent upper sides 46 of dispenser slot 131 are tapered and terminate in shoulders 47. As a result of this construction, the cam assembly spacer 130 is readily inserted into the slot 131 and is then locked within the slot by shoulders 47.

Referring further to FIG. 7, in another alternative embodiment 100 of my present invention, side panels 111 and end panels 113 are molded as a single unitary part, which may also include stationary handle 137. Here, instead of the flaps 23 and end panels 13 being formed from a corrugated panel as is the case in the embodiments shown in FIGS. 1–6, the separately formed flaps 123 are attached to the end panels 113 by pivot pins 48. Cam follower tabs 124 are formed as integral parts of the flaps 123. Preferably, the biasing springs 26 are attached to rods 49 which are either an integral part of the flaps 123 (as shown) of are pressed or screwed into edge sections of the flaps. The embodiment 100 shown in FIG. 7 has the advantage of being readily adaptable to high speed automated large volume production, while the embodiment 10 of FIGS. 1–6 does not require relatively expansive molds and is readily disassembled for repair or replacement of parts.

Quite obviously, the molded cam assembly 45 and the slot 131 shown in FIG. 7 can be incorporated into the corrugated panel embodiment 10 illustrated in FIGS. 1–6.

An alternative fluidic cylinder-operated arrangement is shown in FIG. 8. The fluidic cylinder is shown adapted to the unitary molded embodiment 100 of my dispensing device, but can also be used with the corrugated panel embodiment 10. Here, a mounting bracket 51 is mounted such as by screws 52 to end panel 111 (or 11) above the movable handle 134 (34). Stationary handle 137 (37) is omitted. A fluidic cylinder 53 is affixed to the bracket 51 in a generally vertical orientation. Operation of the cylinder 53 to extend cylinder rod 54 causes the cylinder rod to move handle 134 downwardly, opening flaps 123. Conversely, retracting the cylinder rod 54 allows the springs 26 to return the flaps 123 to the normally closed position. Alternatively, the cylinder rod 54 can be attached directly to the handle 34 so that the biasing spring 26 acts only to close the flaps 123 and is not required to lift the cam assembly 45 as well. Quite obviously, the cylinder 54 is not the only suitable means for moving the handle. For example, a solenoid could be used.

FIG. 9 schematically depicts one embodiment of a control system for operating the fluidic controlled embodiment (i.e., pneumatic or hydraulic) of the dispensing device. Here, a switch 56 such as a foot pedal is depressed by an operator (not shown) providing a signal over control line 57 for activating means 58 such as an air solenoid valve to apply air under pressure from line 60 over line 59 to the cylinder 53 to extend rod 54. Opening switch 56 releases pressure in line 59 so that the spring-biased cylinder rod 54 is retracted. Quite obviously other arrangements are possible, such as the use of a double action fluidic cylinder in which the cylinder piston is retracted as well as extended by the application of fluid to different inlet ports.

In view of the preferred and alternative embodiments of my device described here, it will be appreciated that the scope of the invention is limited solely by the claims and that those of skill in the art will develop other modifications and embodiments based upon the above teachings which are encompassed within the claims.

I claim:

1. A dispensing device comprising:

a housing having first and second opposed sidewalls and first and second opposed endwalls forming a dispensing opening, one sidewall having a vertical slot therein and a fixed handle mounted proximate the slot;

first and second dispensing flaps joined respectively to the first and second endwalls for pivotal movement within the housing between a closed first position and an open second dispensing position, each flap having side edges;

first cam follower member extending from one of the side edges of the first flap, and a second cam follower member extending from one of the side edges of the second flap, biasing means connected to said flaps for normally holding said flaps in the first position; and a cam means comprising a cam member within the housing adapted by a spacer mounted thereto and extending through the slot for movement along a predetermined path for forcing apart the cam followers and thereby pivoting said flaps to the opened second position; and an actuating handle mounted to the spacer proximate the fixed handle for cooperatively providing a squeeze handle action in conjunction with the fixed handle to move the cam member along the predetermined path.

2. The dispensing device of claim 1 wherein each endwall and joined flap form a unitary structure implementing a plate of corrugated material comprising a pair of generally parallel sheets having length and width and being separated by internal ribs defining laterally extending flutes between the sheets; and one of each pair of sheets having a lateral slit therein defining a hinge in the corresponding lateral area of the second sheet for providing said pivotal movement and for separating the plate into the endwall and flap.

3. The dispensing device of claim 2, at least one endwall being attached to an adjoining one of said corrugated sidewalls by a securing member attached to the sidewall and inserted into a flute of the adjoined endwall.

4. The dispensing device of claim 2, at least one of the first and second endwalls being attached to adjoining sections of the opposed sidewalls by a rod member extending through a flute of the endwall and being adapted for attachment at opposite ends of the flute to the opposed sidewalls.

5. The dispensing device of claim 2, the cam follower members comprising first and second pins inserted into and extending from flutes in the first and second flaps, respectively.

6. The dispensing device of claim 5, said biasing means comprising an extension spring connected between said cam follower pins.

7. The dispensing device of claim 2 wherein said handle spacer, and cam are formed as a unitary structure.

8. The dispensing device of claim 2, further comprising means adapted for and selectively actuable for moving said handle along the predetermined path; and means for actuating said handle moving means.

9. The dispensing device of claim 1 wherein said endwalls and sidewalls are formed as a unitary structure.

10. The dispensing device of claim 1 the cam follower members comprising first and second pins extending from the first and second flaps, respectively.

11. The dispensing device of claim 10, said biasing means comprising an extension spring connected between said cam follower pins.

12. The dispensing device of claim 11, further comprising means adapted for and selectively actuable for moving said handle along the predetermined path; and means for actuating said handle moving means.

13. The dispensing device of claim 1, said cam member being positioned between and engaging said first and second cam followers and having first and second sections of selected dimensions generally transverse to the predetermined path for establishing the between-flap spacing for the closed first position and the open second position.

* * * * *